US011530858B2

(12) United States Patent
Cools et al.

(10) Patent No.: US 11,530,858 B2
(45) Date of Patent: Dec. 20, 2022

(54) CONTROLLER FOR COMPRESSOR

(71) Applicant: ATLAS COPCO AIRPOWER, NAAMLOZE VENNOOTSCHAP, Wilrijk (BE)

(72) Inventors: Pieter Michel Mena Cools, Wilrijk (BE); Yogesh Avinash Krishnasing, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 86 days.

(21) Appl. No.: 16/089,962

(22) PCT Filed: Apr. 11, 2017

(86) PCT No.: PCT/IB2017/052086

§ 371 (c)(1),
(2) Date: Sep. 28, 2018

(87) PCT Pub. No.: WO2017/178970

PCT Pub. Date: Oct. 19, 2017

(65) Prior Publication Data

US 2019/0113263 A1 Apr. 18, 2019

Related U.S. Application Data

(60) Provisional application No. 62/321,418, filed on Apr. 12, 2016.

(30) Foreign Application Priority Data

Apr. 11, 2017 (BE) ..... 2017/5254

(51) Int. Cl.
*F25B 49/02* (2006.01)
*F04C 23/00* (2006.01)
(Continued)

(52) U.S. Cl.
CPC ..... *F25B 49/025* (2013.01); *F04C 23/001* (2013.01); *F04C 28/08* (2013.01);
(Continued)

(58) Field of Classification Search
CPC F25B 49/025; F25B 2600/021; F04C 23/001; F04C 28/08; F04C 29/04; F04C 2240/808
See application file for complete search history.

(56) References Cited

U.S. PATENT DOCUMENTS 4,044,285 A * 8/1977 Plunkett ..... H02P 21/10 318/803
2004/0244393 A1 12/2004 Lucas et al.
(Continued)

FOREIGN PATENT DOCUMENTS

KR 20110014435 A * 2/2011
WO 2006093647 A1 9/2006
WO WO-2006093647 A1 * 9/2006 ..... H02H 9/001

OTHER PUBLICATIONS

Ivan, System for precharging a de link in a variable speed drive Feb. 9, 2006, Full Document (Year: 2006).*
(Continued)

*Primary Examiner* — Nael N Babaa
(74) *Attorney, Agent, or Firm* — Bacon & Thomas, PLLC

(57) ABSTRACT

A controller for a compressor, more specifically for a first electrical VSD motor configured to drive a compressor element, the controller including a housing in which is provided a rectifier, a DC link with a DC bus and two inverters connected to the same DC bus, a first inverter configured to control the first VSD motor driving the compressor element, and a second inverter configured to control a second VSD motor driving a fan configured to cool the compressor.

15 Claims, 3 Drawing Sheets

(51) Int. Cl.
*F04C 28/08* (2006.01)
*F04C 29/04* (2006.01)

(52) U.S. Cl.
CPC ..... *F04C 29/04* (2013.01); *F04C 2240/808* (2013.01); *F25B 2600/021* (2013.01)

(56) References Cited

U.S. PATENT DOCUMENTS

2006/0158131 A1* 7/2006 Mitsuyasu ..... H02M 7/53803 315/209 R
2007/0063668 A1* 3/2007 Schnetzka ..... H02M 5/458 318/812
2007/0151272 A1 7/2007 Cosan et al.
2010/0307177 A1* 12/2010 Lifson ..... F25B 49/022 62/115
2011/0083454 A1* 4/2011 Kopko ..... F25B 49/027 62/115
2012/0210037 A1* 8/2012 Kiesel ..... H05K 7/1468 710/305
2013/0088238 A1* 4/2013 Julicher ..... G08B 17/113 324/469
2013/0125543 A1* 5/2013 Hoover ..... F02B 37/18 60/605.1
2013/0296987 A1* 11/2013 Rogers ..... A61F 7/007 607/112
2014/0100709 A1* 4/2014 Sakurai ..... H05K 7/20836 700/300
2014/0144083 A1* 5/2014 Artwohl ..... G09F 23/065 49/70
2014/0277818 A1* 9/2014 Peterson ..... G06F 1/206 700/300
2016/0149531 A1* 5/2016 Yoshida ..... H02H 11/006 318/490
2016/0290671 A1* 10/2016 Schuster ..... F25B 49/022

OTHER PUBLICATIONS

Hwan, Air Conditioner, Aug. 5, 2009, Full Document (Year: 2009).*
International Search Report in related PCT Application No. PCT/IB2017/052086, dated Jun. 22, 2017.
Written Opinion in related PCT Application No. PCT/IB2017/052086, dated Jun. 22, 2017.
International Preliminary Report on Patentability in related PCT Application No. PCT/IB2017/052086, dated Jun. 28, 2018.

* cited by examiner

CONTROLLER FOR COMPRESSOR

This invention relates to a controller for a compressor, more specifically for an electrical VSD motor configured to drive a compressor element.

BACKGROUND OF THE INVENTION

Controllers are typically used within a compressor for controlling the functioning capabilities of an electrical VSD motor.

Typically such a compressor would have a main controller receiving input from a user concerning the requirement of the compressed gas at its outlet and another controller typically in communication with the main controller and adjusting the functionality of the motor in order to achieve such required properties of compressed gas.

If the compressor further comprises other components such as a cooler or a dryer or the like, the existing units would typically include for each of such components a separate controller preferably communicating with the main controller.

Consequently, the compressors can become very complex systems, having a plurality of controllers with all required communication paths, cables and connectors, potentially needed pipes and fittings.

The complexity becoming even worse in the case of compressors having more than one compressor element connected either in series or in parallel, each compressor element potentially having its own motor.

Another drawback of existing compressors is the complex service operation, since when one of the controllers would sense a malfunction, the whole system would be brought to a force stop and the engineer performing the servicing would have to check all such controllers and their cable connections until finding the faulty component. This would mean that such compressor would not be functional for a very long time, causing additional costs for a user of such system not only for the servicing procedure but also because the compressor is not functional during this time, which can bring the user's system to a halt.

SUMMARY OF THE INVENTION

Taking the above mentioned drawbacks into account, it is an object of the present invention to provide a much simpler controller capable of controlling multiple motors at the same time.

Another object of the present invention is to provide controller that would require a much easier and faster servicing operation.

Yet another object is to provide a much more compact solution, requiring less external communication paths such as cables and connectors, reducing the possibility of encountering measurement errors and decreasing the manufacturing costs.

A further object of the present invention is to increase the energy efficiency of such compressor, while at the same time maintaining the cooling efficiency.

The present invention solves at least one of the above and/or other problems by providing a compressor comprising a controller connected to a first VSD motor for driving a compressor element of said compressor, whereby the controller is further connected to a second VSD motor for driving a cooling fan configured to cool said compressor, said controller comprising a housing in which is provided a rectifier, a DC link with a DC bus and two inverters connected to the same DC bus, a first of said inverters configured to control the VSD motor driving said compressor element, and a second of said inverters configured to control a VSD motor driving a fan configured to cool the compressor.

Because the controller comprises a housing whereby the two inverters are provided, such a controller will cover the capabilities of at least two controllers when compared to the controllers of an existing compressor.

Such a controller being much easier to manufacture, being a much more compact solution and be much easier to incorporate within the compressor. It will also require less communication paths such as cables and connectors.

Because the controller comprises the needed components within the same housing, the possibility of encountering communication errors between such components it's minimized if not eliminated.

Furthermore, the servicing procedure is much easier to perform, reducing the number of hours in which the compressor is not functioning.

Because the controller is provided with a housing for all its elements, such controller will be protected from potentially damaging effects of the outside environment, from potentially high humidity and particulate matter, and also from high temperature changes.

By adopting such a layout for the controller according to the present invention, the motor driving the fan will be in fact be driven by varying its speed and not in an on/off manner as for the existing compressors. By doing this, the energy efficiency of the compressor is maintained high, and the lifetime of the motor is increased.

The present invention is further directed to a vacuum pump comprising a controller according to the present invention, the controller being connected to a first VSD motor for driving a vacuum element of said vacuum pump whereby the controller is further connected to a second VSD motor for driving a cooling fan configured to cool said vacuum pump, said controller comprising a housing in which is provided a rectifier, a DC link with a DC bus and two inverters connected to the same DC bus, a first inverter configured to control the first VSD motor driving said vacuum element, and a second inverter configured to control the second VSD motor driving the fan.

BRIEF DESCRIPTION OF THE DRAWINGS

In the context of the present invention it should be understood that the benefits presented with respect to the controller also apply for the compressor and for the vacuum pump.

With the intention of better showing the characteristics of the invention, some preferred configurations according to the present invention are described hereinafter by way of an example, without any limiting nature, with reference to the accompanying drawings, wherein.

DETAILED DESCRIPTION OF THE INVENTION

Figure 1:
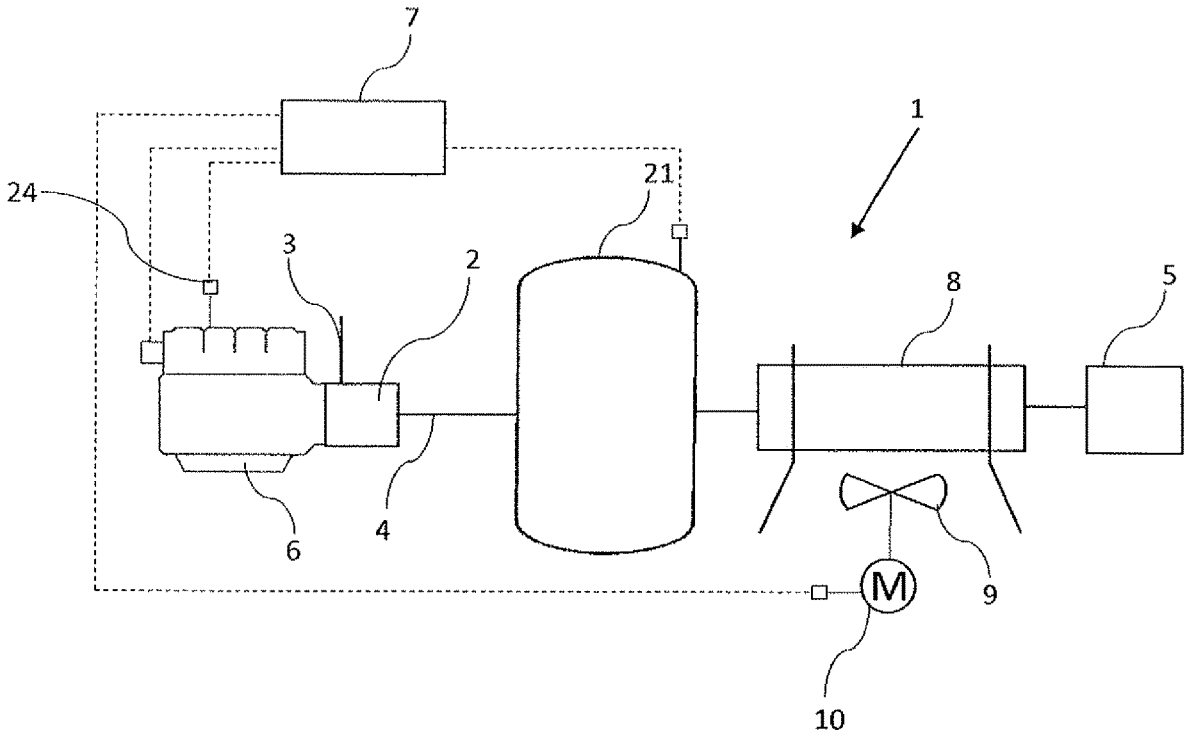
FIG. 1 schematically represents a compressor according to an embodiment of the present invention.

FIG. 1 illustrates a compressor 1 comprising a compressor element 2 having a gas inlet 3 through which ambient air or a gas from an external source (not shown) is drawn in, and a compressed gas outlet 4 through which compressed gas is provided to a user's network 5.

The compressor element 2 being driven by a first variable speed (VSD) motor 6.

The compressor further comprising a controller 7 capable of controlling the variable speed motor 6.

Preferably, such a compressor further comprises an aftercooler 8 comprising a fan 9, said fan 9 being driven by a second VSD motor 10. The controller 7 being able to control said second VSD motor 10.

In the context of the present invention, the compressor 1 should be understood as the complete compressor installation, including the compressor element 2, all the typical connection pipes and valves, the aftercooler 8, the housing of the compressor 1 and possibly the first VSD motor 6 and the second VSD motor 10.

In the context of the present invention, the compressor element 2 should be understood as the compressor element casing in which the compression process takes place by means of a rotor or through a reciprocating movement.

In the context of the present invention, said compressor element 2 can be selected from a group comprising: a screw, a tooth, a claw, a scroll, a rotary vane, a centrifugal, a piston, etc.

By controlling a variable speed motor it should be understood that the controller 7 generates a signal which is sent through a wired or wireless connection to possibly a local controller of such variable speed motor, said signal being capable of changing the rotational speed of the variable speed motor by increasing or decreasing it. Another possibility is for said signal generated by the controller 7 to directly change the rotational speed of the variable speed motor through a wired or wireless connection.

If the connection is wired, such connection typically comprises a wire with two connectors at each end.

If the connection is wireless, each of the controller 7 and the variable speed motor, preferably comprises a wireless transceiver capable of sending and receiving a wireless signal.

In one embodiment according to the present invention, the controller 7 receives data concerning the requirements of the compressed gas through a graphical user interface (not shown) part of said controller 7, or through a main controller (not shown) part of said compressor 1 and in communication with said controller 7.

Figure 2:
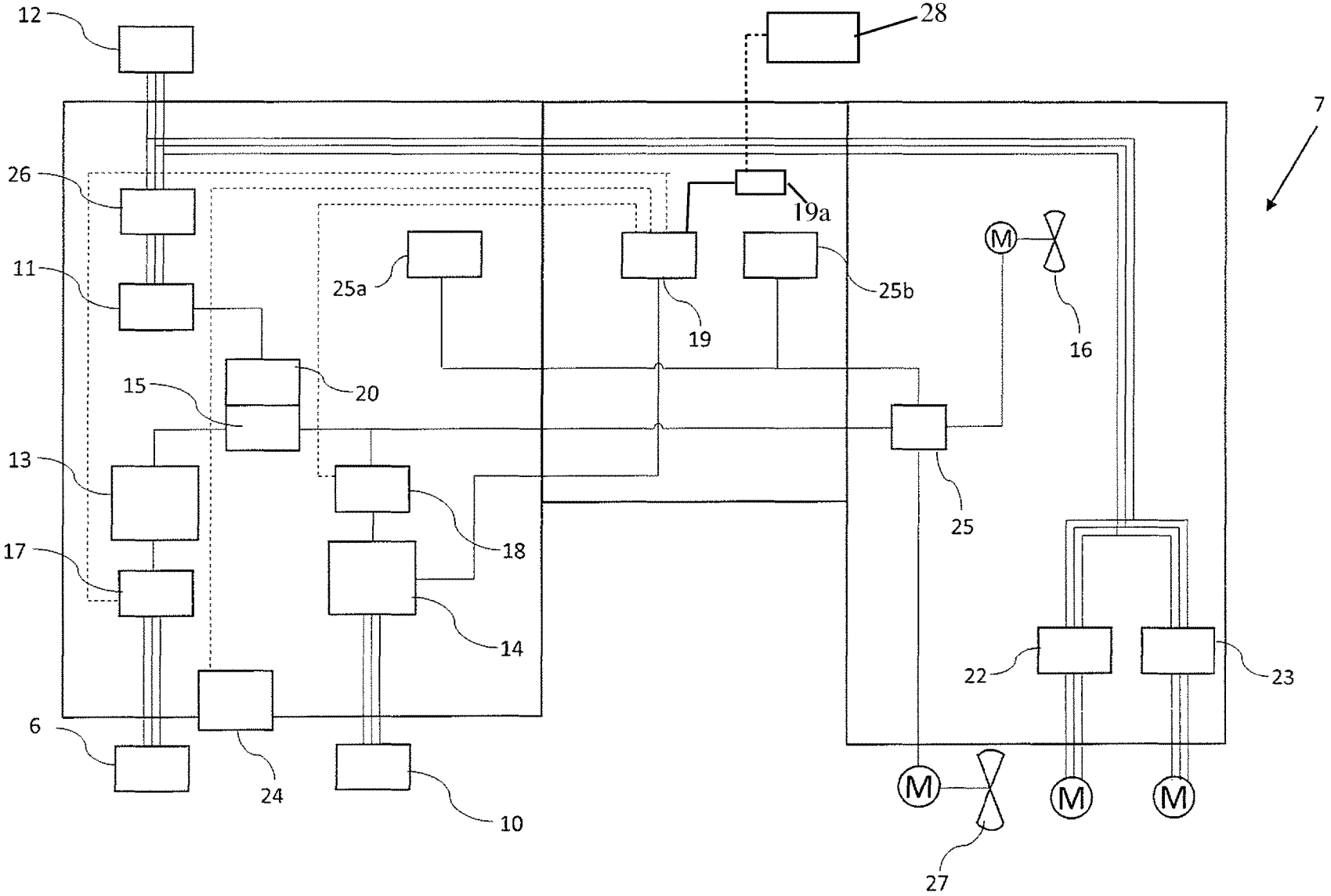
FIG. 2 schematically represents a controller according to an embodiment of the present invention.

Turning now to FIG. 2, the controller 7 comprises a rectifier 11 connected to a main power line 12 from the user's premises, receiving alternative current (AC) from said power line and transforming the alternative current into direct current (DC).

A DC link with a DC bus allows for the two inverters to be connected to the two variable speed motors: a first inverter 13 connected to the first variable speed motor 6 and a second inverter 14 connected to the second variable speed motor 10. Said DC bus being a common bus for the two inverters.

The first and second inverter, 13 and 14, would preferably change the DC current into AC current and will also control the frequency and voltage of the signal reaching the first variable speed motor 6 and the second variable speed motor 10. By controlling the frequency and voltage, the speed of the two variable speed motors is controlled such that the demand at the user's network is met.

In a preferred embodiment according to the present invention, each of said first and second inverters, 13 and 14, comprises at least one IGBT (Insulated-Gate Bipolar Transistor) which is connected to said DC bus.

For a more smooth control, the controller 7 further comprises a DC link capacitor 15, connected between the rectifier 11 and the first and second inverters, 13 and 14, said capacitor 15 smoothening the electrical wave form such that the first and second inverters, 13 and 14, will receive a clean smooth signal.

In another embodiment according to the present invention, the controller 7 can further comprise a separate cooling fan 16 for cooling the power electronics of said controller 7.

By including such a separate cooling fan 16, the controller 7 will be protected from overheating and the compressor 1 will not experience a force shut down because of an increased temperature at the level of said controller 7.

In a further embodiment according to the present invention, the controller 7 further comprises a first current sensor 17 for sensing the current going through a winding of the first VSD motor 6 driving the compressor element 2.

Said first current sensor 17 being any type of current sensor such as for example and not limiting thereto: a current clamp meter, a Hall effect Integrated Circuit, a resistor, a fiber optic current sensor, a Rogowski coil.

Preferably, the first current sensor 17 is selected as a clamp meter, said clamp meter being clamped onto at least two phases of the first variable speed motor 6 and of the second variable speed motor 10 respectively. It is further possible to have a clamp meter clamped around three phases of said first variable speed motor 6 and of said second variable speed motor 10 respectively.

Such first current sensor 17 measuring the current going through the windings of the first variable speed motor 6 and second variable speed motor 10 respectively, and send such values to a processing unit 19 part of the controller 7.

Said processing unit 19 preferably comparing the received measurement with a predetermined current limit and in case the measured current is equal to or higher than the predetermined current limit, the controller unit will stop the compressor 1, protecting the first variable speed motor 6 and the second variable speed motor 10 from an overcurrent.

It is further possible to compare the measured current with a first predetermined current limit and if said measured current is equal to or higher than said first predetermined current limit, but lower than a second predetermined current limit, the controller 7 generates an alert signal on the graphical user interface. However, if the measured current is equal to or higher than the second predetermined current limit, the controller 7 stops the compressor 1.

Further, the measured current is also compared with a minimum predetermined current limit and if the measured current is equal to or lower than such a minimum predetermined current limit, then the controller 7 stops the compressor 1.

It should be further not excluded, that the controller can compare the measured current with more predetermined limits and generate different messages on the graphical user interface, or less predetermined limits and possibly take immediate action and stop the compressor 1.

In the context of the present invention, it should be understood that the predetermined current limit, the first current limit, the second current limit and the minimum predetermined current limit can have the same values for the measurements on the first VSD motor 6 as well as for the second VSD motor 10, or these values can be different.

Preferably, such values are selected according to the nominal functioning parameters for each of the first VSD motor 6 and of the second VSD motor 10.

In yet another embodiment according to the present invention, the controller 7 further comprises a second current sensor 18 for sensing the current going through a winding of the second VSD motor 10 driving the fan 9.

Said second current sensor 18 preferably being a module determining the current going through the second VSD motor 10 by applying a voltage over frequency method. Accordingly, the voltage is measured, the frequency of the second VSD motor 10 is also retrieved and the current is further determined.

It should be however not excluded that the second current sensor 18 can be of the same type as the first current sensor 17.

Tests have shown that by including a first current sensor and a second current sensor 18, the controller 7 according to the present invention comprises an electrical protection to overcurrent, which is much more reliable and accurate compared to existing controllers typically having a mechanical protection for the current.

In another embodiment according to the present invention, the controller further comprises a voltage sensor 20 for sensing the value of the voltage at the level of the first variable speed motor 6 driving the compressor element 2 and/or of the second variable speed motor 10 driving the fan 9.

Preferably but not limiting thereto, the voltage sensor 20 is positioned on the DC bus, between the rectifier 11 and the capacitor 15, measuring the voltage of both the first VSD motor 6 and of the second VSD motor 10.

The processing unit 19 of said controller 7 preferably comparing the measured voltage with a predetermined voltage limit and if the measured voltage is equal to or higher than said predetermined voltage limit, the controller 7 will stop the compressor 1.

Further, the processing unit 19 can compare the measured voltage with a predetermined minimum voltage limit and if the measured voltage is equal to or lower than the predetermined minimum voltage, the controller 7 will stop the compressor 1.

It should be further not excluded that the processing unit can compare the measured voltage with more predetermined limits and, depending on the limits, it can generate alerts on the graphical user interface or stop the compressor 1.

In another embodiment according to the present invention, the controller 7 further comprises a communication module 19*a* adapted to establish a communication link with an external device 28.

A communication link should be understood as a connection between two terminals, allowing for a signal to pass therethrough.

Such a connection being realized through a wired or wireless medium.

An external device should be understood as any type of device capable of receiving and transmitting a signal through such a communication link, such as selected from a group comprising: a personal computer, a laptop, a phone, a tablet, a personal digital assistant, the cloud, or any other device.

The controller 7 can be further adapted to receive initialization data through such a communication link.

Accordingly, a user of a compressor 1 according to the present invention can connect to the controller 7 remotely and send data such as for example and not limiting thereto: the predetermined current limit, the first current limit, the second current limit and the minimum predetermined current limit, a maximum and a minimum voltage, a predetermined voltage limit, a predetermined minimum voltage limit and possibly additional limits thereof.

It can further receive information concerning a maximum and minimum speed of the first VSD motor 6 and of the second VSD motor 10.

In another embodiment according to the present invention, the compressor 1 further comprises a dryer 21, said dryer typically comprising a third motor (not shown) and a forth motor for driving a fan.

The third motor and the forth motor are preferably each connected to the controller through a Solid State Relay, 22 and 23.

Each SSR being connected to each of the third motor and the forth motor through a three phase connection. Said third and fourth motor being controlled by the controller 7 in an ON/OFF manner.

When compared to known controllers, this offers the advantage that the controller 7 according to the present invention makes the compressor 1 more durable and that the servicing interventions can be performed at longer time intervals.

In another embodiment according to the present invention, the controller 7 further comprises a communication link to a temperature sensor 24, said temperature sensor 24 being at the level of or in the vicinity of the first VSD motor 6. Said temperature sensor sending a measured temperature to the processing unit, whereby it is compared with a minimum threshold and a maximum threshold.

If the measured temperature is equal to or lower than said minimum threshold, the controller 7 can stop the compressor 1, or said controller can disconnect the user's network 5 and maintain the first VSD motor 6 functioning until the measured temperature is at least equal to said minimum threshold, moment when the controller 7 reconnects the user's network 5.

If said measured temperature is equal to or higher than the maximum threshold, the controller unit can stop the compressor 1.

Such measures protect the first VSD motor 6 from running at a high load while being at very low temperature, and it also protects it from overheating.

It should be further understood that additional temperature thresholds could be also used, said additional temperature thresholds being selected between the minimum threshold and the maximum threshold. When such thresholds are being reached, the controller 7 can increase or decrease the speed of the first VSD motor 6 such as to control the temperature.

In a further embodiment according to the present invention, the controller 7 further comprises an internal power supply 25. The internal power supply 25 receiving power from the DC bus and providing power to the first VSD motor 6, the second VSD motor 10, it can further supply the necessary power to the main controller, and possibly to other components part of the compressor 1 such as valves, etc.

If the controller 7 comprises multiple printed circuit boards (PCB), as it is shown in the example of FIG. 2, the power supply 25 can provide the necessary power for each of said PCBs, through internal supplies 25*a* and 25*b*.

It should not be excluded that other temperature sensors can also be provided, such as for example and not limiting thereto: a temperature sensor for each of the IGBTs, a temperature sensor for the internal power supply 25, a temperature sensor for the PCB board of the controller 7, even an ambient temperature sensor, etc.

If the temperature of the IGBTs is measured, once such temperature reaches a predetermined threshold, the controller 7 can increase or decrease the speed of the first VSD motor 6 and/or of the second VSD motor 10. It could alternately or cumulatively increase or decrease the frequency or the torque of the first VSD motor 6 and/or of the second VSD motor 10 or it can also stop the first VSD motor 6 and/or the second VSD motor 10.

If an ambient temperature sensor is provided, if the measured ambient temperature would reach a predetermined ambient threshold, the controller 7 can decrease the speed of the first VSD motor 6 in order to protect it from overheating or can increase such sped in order to maintain a minimum temperature within the compressor 1.

Further, the controller 7 can also comprise an ambient humidity sensor. The measured ambient humidity can be used for avoiding condensate formation within one or more of the following: the first VSD motor 6, the second VSD motor 10, and within the controller 7. Accordingly, if the measured ambient humidity is above a humidity limit, the controller can maintain the first VSD motor 6 and/or the second VSD motor 10 running such that their temperature is maintained relatively high and condensate cannot form.

For maintaining the temperature of the controller 7 at safe levels the controller 7 further comprises a heat sink (not shown) a first fan 16 for creating an internal flow of air within the housing and a second fan 27 positioned on the exterior of said housing for cooling the heatsink.

In a preferred embodiment according to the present invention and not limiting thereto, the rectifier 11, the DC link with the DC bus and the two inverters are on one Printed Circuit Board.

By adopting such a layout, the controller 7 according to the present invention is even more compact, easier to manufacture and easier to change in case it is damaged.

The controller 7 according to the present invention not only realizes an efficient protection of the compressor 1 but it also increases the lifetime of the components part of the compressor 1.

For further protection the controller 7 further comprises an AC choke and an EMC (Electromagnetic Compatibility) filter 26 connected between the inlet connector through which the controller 7 is connected to the main power line 12 of the user and the rectifier 11.

The present invention is further directed to a compressor comprising a controller 7 according to the present invention, the controller 7 being connected to a first VSD motor 6 for driving a compressor element 2 and further connected to a second VSD motor 10 for driving a cooling fan 9 configured to cool said compressor.

In a preferred embodiment according to the present invention, said compressor 1 does not have a relay cabinet.

Because of this the compressor 1 according to the present invention is much less complex.

Figure 3:
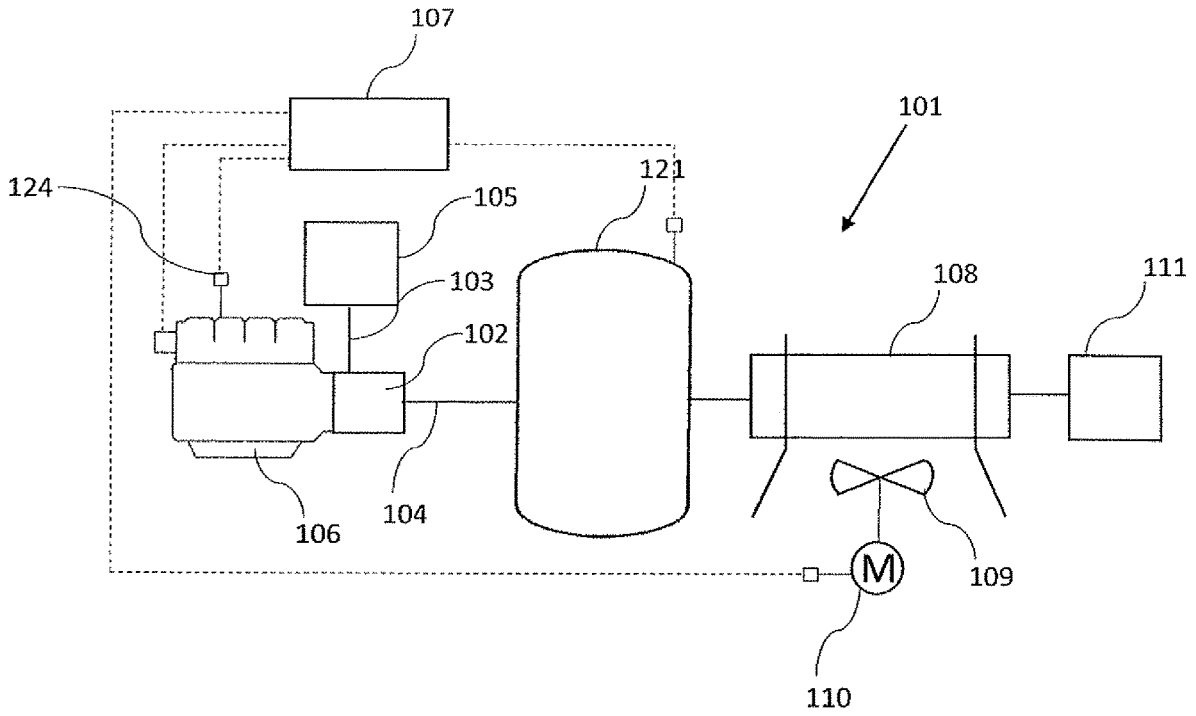
FIG. 3 schematically represents a vacuum pump according to an embodiment of the present invention.

It should however not be excluded that the controller 107 according to the present invention can be also provided within a vacuum pump 101, as illustrated in FIG. 3.

If such a controller 107 is provided in a vacuum pump 101, the system would be similar as for a compressor 1, the only difference would be that the gas inlet 103 receives gas from a user's network 105, and the vacuum outlet 104 is connected to the environment or to an external network 111.

Similarly to the compressor 1 of FIG. 1, the vacuum pump 101 comprises a vacuum element 102 being driven by a first variable speed motor 106. The vacuum pump 101 further comprising a temperature sensor 124.

Further similarly, the vacuum pump 101 further comprises a dryer 121 and an aftercooler 108 comprising a fan 109 driven by a second variable speed motor 110.

The present invention is by no means limited to the embodiments described as an example and shown in the drawings, but such a controller 7 can be realized in all kinds of variants, without departing from the scope of the invention.

The invention claimed is:

1. A compressor comprising:

a controller connected to a first Variable Speed Drive (VSD) motor for driving a compressor element of said compressor, wherein the controller is further connected to a second VSD motor for driving a cooling fan configured to cool said compressor, said controller comprising a housing for all elements protected from an outside environment in which is provided a rectifier, a Direct Current (DC) link with a DC bus and two inverters connected to the same DC bus, a first inverter configured to control a frequency and a voltage of the first VSD motor driving said compressor element, and a second inverter configured to control a frequency and a voltage of the second VSD motor driving the fan, wherein said control varies the speed of the second VSD motor, wherein the controller further comprises a voltage sensor positioned on the DC bus that measures a voltage of the first VSD motor and/or of the second VSD motor, wherein the controller is configured to stop the compressor when the measured voltage is equal to or higher than a predetermined voltage limit or when the measured voltage is equal to or lower than a predetermined minimum voltage, wherein a DC link capacitor is connected between the rectifier and the first and second inverters, and wherein the compressor is a compressed gas compressor comprising an inlet for receiving ambient air and a compressed gas outlet.

2. The compressor according to claim 1, wherein said compressor does not have a relay cabinet.

3. The compressor according to claim 1, wherein each of said inverters comprises at least one Insulated-Gate Bipolar Transistor (IGBT) which is connected to said DC bus.

4. The compressor according to claim 1, wherein the controller further comprises a separate cooling fan for cooling power electronics of said controller.

5. The compressor according to claim 1, wherein the controller further comprises a first current sensor for sensing current going through a winding of the first VSD motor.

6. The compressor according to claim 5, wherein the controller further comprises a second current sensor for sensing current going through a winding of the second VSD motor.

7. The compressor according to claim 6, wherein the controller further comprises an electrical protection to overcurrent.

8. The compressor according to claim 1, wherein the controller further comprises a communication link to a temperature sensor, said temperature sensor being at the first VSD motor driving the compressor element.

9. The compressor according to claim 1, wherein the controller further comprises an internal power supply.

10. The compressor according to claim 1, wherein the rectifier, the DC link with the DC bus and the two inverters are on one Printed Circuit Board.

11. The compressor according to claim 1, further comprising an ambient humidity sensor, wherein if a measured humidity is above a humidity limit, the controller maintains the first VSD motor and/or the second VSD motor at a high temperature so that condensate cannot form.

12. The compressor according to claim 1, wherein the compressed gas outlet is connected to a compressed gas user network.

13. The compressor according to claim 1, wherein the controller receives data concerning a requirement of a compressed gas.

14. A controller adapted to be connected to a first Variable Speed Drive (VSD) motor for driving a compressor element of a compressor or for driving a vacuum pump, and said controller is further adapted to be connected to a second VSD motor for driving a cooling fan configured to cool said compressor or said vacuum pump, said controller comprising a housing for all elements protected from an outside environment in which is provided a rectifier, a Direct Current (DC) link with a DC bus and two inverters connected to the same DC bus, a first inverter configured to control a frequency and a voltage of the first VSD motor driving, and a second inverter configured to control a frequency and a voltage of the second VSD motor, wherein said control varies the speed of the second VSD motor, wherein the controller further comprises a voltage sensor positioned on the DC bus that measures a first voltage of the first VSD motor and a second voltage of the second VSD motor, wherein the controller is configured to stop the compressor or vacuum pump when the measured voltage is equal to or higher than a predetermined voltage limit or when the measured voltage is equal to or lower than a predetermined minimum voltage, wherein a DC link capacitor is connected between the rectifier and the first and second inverters, and wherein the compressor is a compressed gas compressor comprising an inlet for receiving ambient air and a compressed gas outlet or the vacuum pump comprises an inlet for receiving ambient air.

15. The controller according to claim 14, wherein said controller is further configured to generate an alert when the measured voltage is compared to an additional limit.

* * * * *